US008907743B2

(12) United States Patent
Shiue et al.

(10) Patent No.: US 8,907,743 B2
(45) Date of Patent: Dec. 9, 2014

(54) DELAY LINE STRUCTURE

(75) Inventors: Guang-Hwa Shiue, Chung Li (TW); Po-Wei Chiu, Chung Li (TW)

(73) Assignee: Chung Yuan Christian University, Chung Li (TW)

( * ) Notice: Subject to any disclaimer, the term of this patent is extended or adjusted under 35 U.S.C. 154(b) by 700 days.

(21) Appl. No.: 13/181,599

(22) Filed: Jul. 13, 2011

(65) Prior Publication Data

US 2012/0032754 A1 Feb. 9, 2012

(30) Foreign Application Priority Data

Aug. 4, 2010 (TW) ..... 99125913 A

(51) Int. Cl.
*H01P 9/02* (2006.01)

(52) U.S. Cl.
CPC ..... *H01P 9/02* (2013.01)
USPC ..... 333/161; 333/162

(58) Field of Classification Search
CPC ..... H01P 9/02
USPC ..... 333/12, 161, 181, 162, 238, 243
See application file for complete search history.

(56) References Cited

U.S. PATENT DOCUMENTS

| | | | | |
|---|---|---|---|---|
| 4,614,922 | A * | 9/1986 | Bauman et al. | 333/161 |
| 5,039,964 | A * | 8/1991 | Ikeda | 333/181 |
| 5,164,692 | A * | 11/1992 | Gertel et al. | 333/238 |
| 6,621,384 | B1 * | 9/2003 | Handforth et al. | 333/238 |
| 8,610,515 | B2 * | 12/2013 | Lan et al. | 333/161 |

* cited by examiner

*Primary Examiner* — Benny Lee
*Assistant Examiner* — Rakesh Patel
(74) *Attorney, Agent, or Firm* — Rosenberg, Klein & Lee

(57) ABSTRACT

A delay line structure includes a flat spiral delay line and two grounding guard traces. The flat spiral delay line is disposed in the layout layer in a manner of extending from an input end, bending clockwise inward until reaching a U-turn part, continuously extending and bending counterclockwise outward to an out put end so as to form two coupling areas, which are spiral and have an opening respectively. The two grounding guard traces are disposed in the layout layer in a manner of extending from the openings respectively toward the coupling areas, having an interval between the grounding guard traces and the flat spiral delay line, wherein the grounding guard traces close to the openings of the coupling areas are electrically connected to the grounding circuit through a via respectively.

16 Claims, 7 Drawing Sheets

DELAY LINE STRUCTURE

This application claims the benefits of the Taiwan Patent Application Serial NO. 099125913 filed on Aug. 4, 2010, the subject matter of which is incorporated herein by reference.

BACKGROUND OF THE INVENTION

1. Field of the Invention

The present invention relates to a delay line structure, and more particularly to a flat spiral delay line structure with grounding guard traces.

2. Description of the Prior Art

Signal synchronizing is always a concern when it comes to the high speed digital signal. Usually the requirement of synchronizing signals is met by increasing delay time with a delay line.

To save space, the delay line is usually bent. There are various delay lines, among which a flat spiral delay line is very common. Referring to FIG. 1, FIG. 1 illustrates a flat spiral delay line structure in prior art. A flat spiral delay line 11 is bent inward clockwise, then bent outward counterclockwise and is arranged on a substrate 100.

However, bending the delay line forms several coupling line segments in the delay line itself, also generates crosstalk noise disturbance and further affects a signal waveform received—which leads to misinterpretation on a voltage level of a digital signal. As a result, in the prior art, a guard trace with both ends connecting to the ground is utilized for decreasing the crosstalk noise. Referring to FIG. 2, FIG. 2 is a schematic view showing a guard trace with both ends connecting to the ground being applied to a flat spiral delay line in prior art. The flat spiral delay line 11 is bent inward clockwise, then bent outward counterclockwise and is arranged on a substrate 100, and therefore a spiral coupling area H1 with an opening and a spiral coupling area H2 with an opening are formed. A guard trace 12 and a guard trace 13 are inserted in the coupling area H1 and coupling area H2 separately. Moreover, two ends of the guard trace 12 are electrically connected to a grounding layer of the substrate 100 by a via 121 and via 122 while two ends of the guard trace 13 are electrically connected to the grounding layer of the substrate 100 by a via 131 and via 132.

Although the guard traces 12 and 13 can efficiently decrease the crosstalk noise of the flat spiral delay line 11, the coupling area H1 and H2 must be large enough for the vias 122 and 132 to be disposed inside the flat spiral delay line 11, which is difficult to process. That is why, downsizing a structure for the flat spiral delay line 11 is still a difficulty. Meanwhile, since the guard trace 12 and 13 with two ends connecting to the ground can merely be utilized in a structure of microstrip line, the utilization is still limited.

SUMMARY OF THE INVENTION

A delay line structure is provided according to the present invention. The delay line structure does not need the installation of via inside the flat spiral delay line and effectively reduces the crosstalk noise disturbance in the flat spiral delay line.

A delay line structure is disposed on a substrate. The substrate includes a grounding layer and a layout layer, wherein the grounding layer includes a grounding circuit. The delay line structure accordingly includes a flat spiral delay line and two grounding guard traces.

The flat spiral delay line is disposed in the layout layer in a manner of extending from an input end, bending clockwise inward until reaching a U-turn part, continuously extending and bending counterclockwise outward to an out put end so as to form two coupling areas which are spiral and have an opening respectively.

The two grounding guard traces are disposed in the layout layer in a manner of extending from the openings respectively toward the coupling areas, having an interval between the grounding guard traces and the flat spiral delay line, wherein the grounding guard traces close to the openings of the coupling areas are electrically connected to the grounding circuit through a via respectively.

According to an embodiment of the present invention, the flat spiral delay line is disposed in the layout layer in a manner of extending from an input end, bending counterclockwise inward until reaching a U-turn part, continuously extending and bending clockwise outward to an out put end so as to form two coupling areas which are spiral and have an opening respectively.

According to the present invention, the flat spiral delay line includes a strip line.

When compared with the delay line in prior art, which is not installed with grounding guard traces, the present invention avoids the crosstalk noise disturbance by means of two grounding guard traces connecting to the ground with an end. When compared with the serpentine delay line having a guard trace with both ends connecting to the ground in prior art, since there is no need to install the via inside the flat spiral delay line according to the present invention, the problem of being unable to downsize the flat spiral delay line is easily solved.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

The present invention relates to a delay line structure, and more particularly to a serpentine delay line structure with grounding guard traces. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
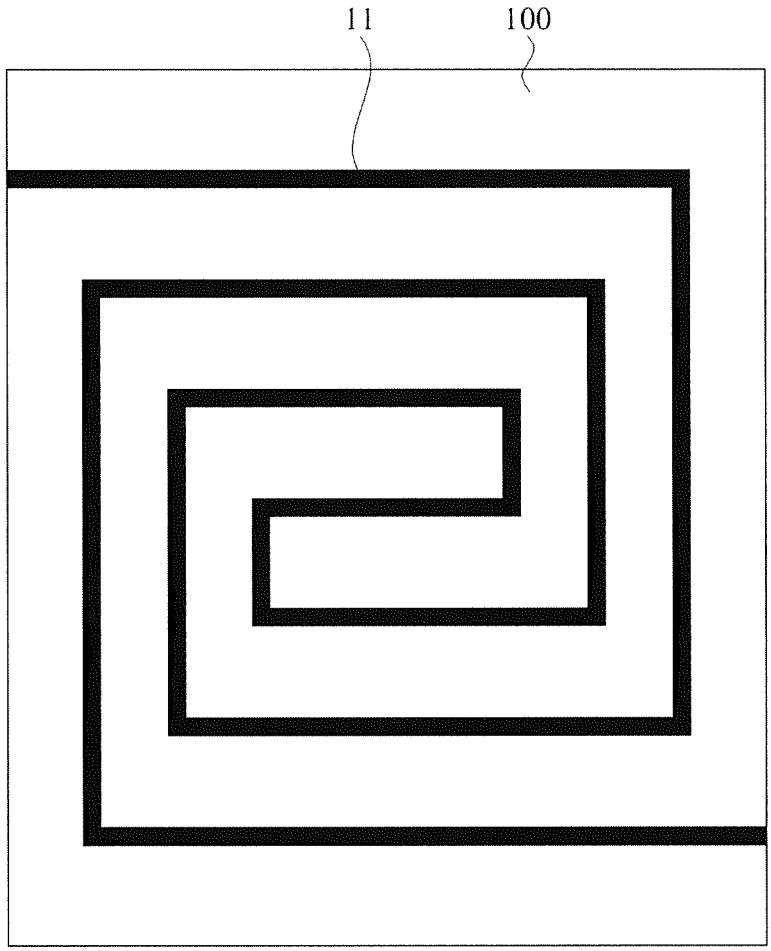
FIG.1(Prior Art)
FIG. 1 shows a delay line structure in the prior art.
Figure 2:
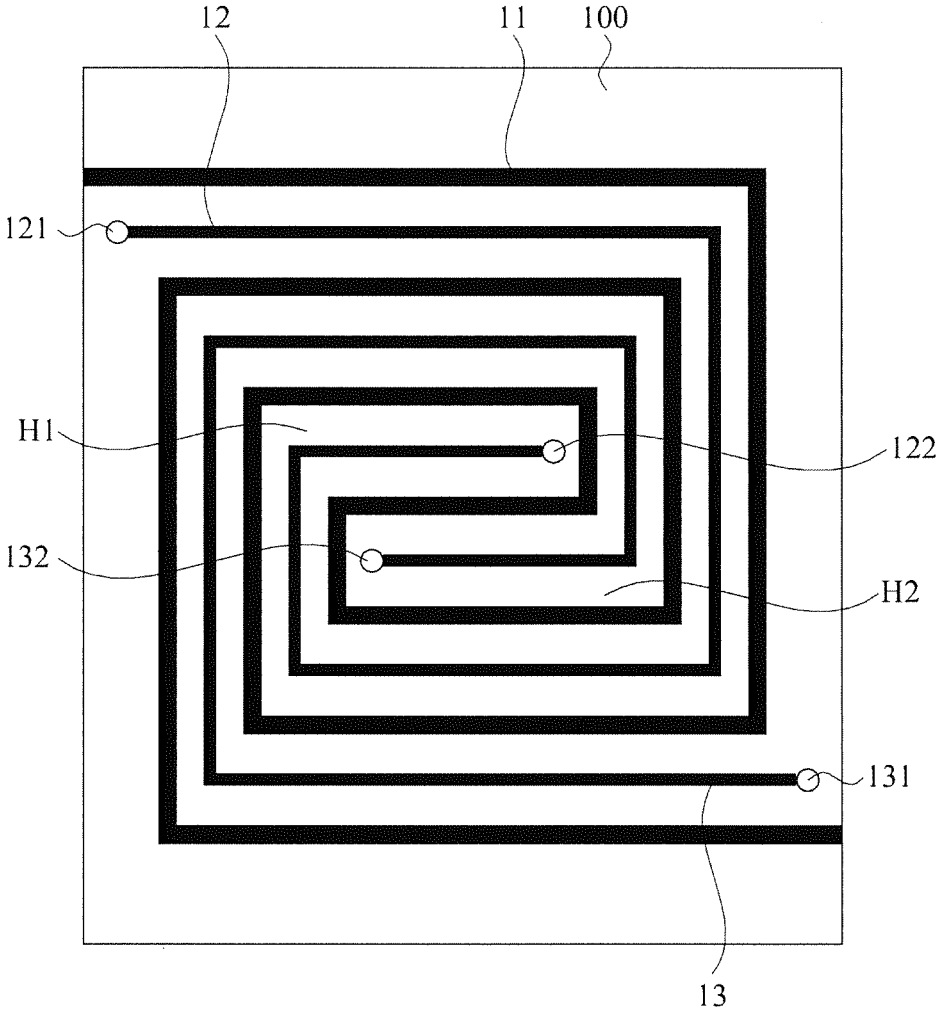
FIG.2(Prior Art)
FIG. 2 is a schematic view showing a guard trace with both ends connecting to the ground being applied to a flat spiral delay line in the prior art.
Figure 3:
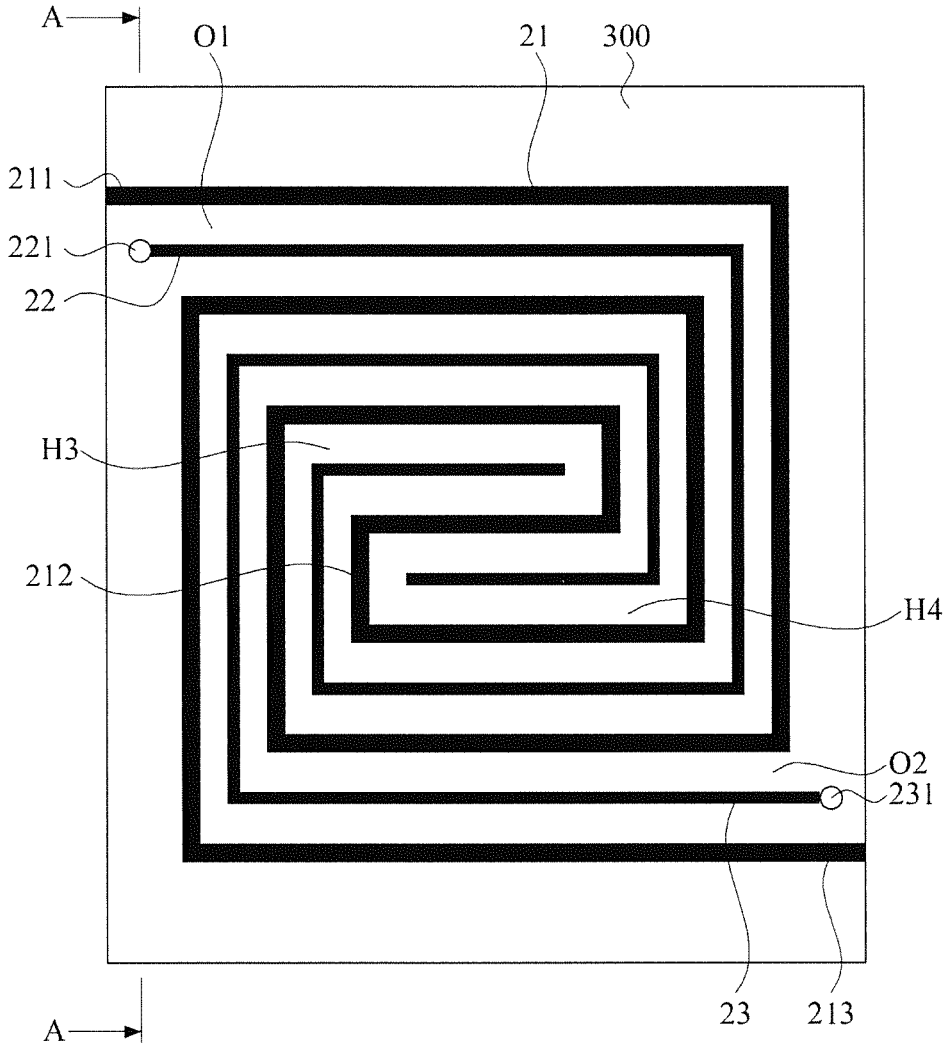
FIG. 3 is the upper view of an embodiment of a flat spiral delay line structure according to the present invention having grounding guard traces.
Figure 4:
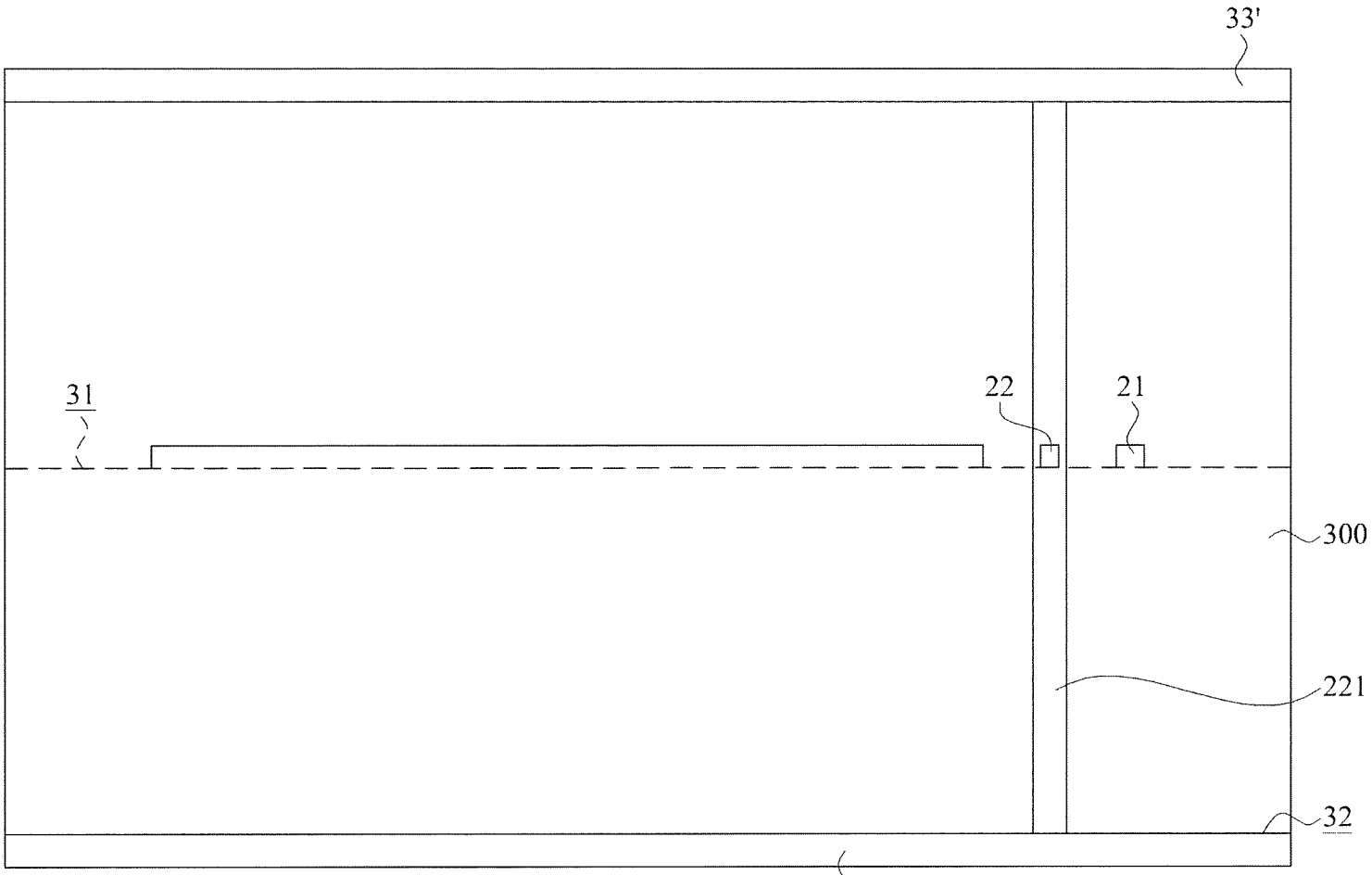
FIG. 4 shows a cross-sectional view of a strip line employed in the flat spiral delay line according to the present invention and is taken along the A-A line in FIG. 3.

Referring to FIG. 3 and FIG. 4, wherein FIG. 3 is the upper view of an embodiment of a flat spiral delay line structure according to the present invention having grounding guard traces while FIG. 4 show a cross-sectional view of the strip line employed in the flat spiral delay line according to the present invention and is taken along the A-A line in FIG. 3. A delay line structure is disposed on a substrate 300. The substrate 300 includes a grounding layer 32 and a layout layer 31, wherein the grounding layer 32 includes a grounding circuit 33. The delay line structure accordingly includes a flat spiral delay line 21 and two grounding guard traces 22 and 23.

The flat spiral delay line 21 is disposed in the layout layer 31 in a manner of extending from an input end 211, bending clockwise inward until reaching a U-turn part 212, continuously extending and bending counterclockwise outward to an out put end 213 so as to form two coupling areas H3 and H4, which are spiral and have opening O1 and O2 respectively. Meanwhile, according to an embodiment of the present invention, the flat spiral delay line 21 is disposed in the layout layer 31 in a manner of extending from the input end 211, bending firstly counterclockwise inward until reaching the U-turn part 212, continuously extending and bending clockwise outward to the out put end 213. The structure is similar to that of FIG. 3; therefore, no detailed description is omitted herein for the sake of brevity.

The two grounding guard traces 22 and 23 are disposed in the layout layer 31 in a manner of extending from the openings O1 and O2 respectively toward the coupling areas H3 and H4, having an interval between the grounding guard traces 22 and 23 and the flat spiral delay line 21, wherein the grounding guard traces 22 and 23 close to the openings O1 and O2 of the coupling areas H3 and H4 are electrically connected to the grounding circuit 33 through via 221 and 231 respectively. According to an embodiment of the present invention, the grounding guard traces 22 and 23 are electrically connected to the vias 221 and 231 respectively by an end positioned outside the openings O1 and O2.

Moreover, the delay line structure of the present invention is applied to various kinds of substrate 300. For example, the substrate 300 may include materials having a plurality of dielectric constants and the substrate 300 may include materials having a single dielectric constant. The layout layer 31 is disposed inside the substrate 300 as shown in FIG. 4. According to an embodiment of the present invention, the flat spiral delay line 21 includes a strip line, and the upper side and lower side of the substrate 300 respectively includes grounding circuit 33 and 33'. When at least one of the grounding circuit 33 and 33' is electrically connected by the via 221, the effect of ground guard is reached.

Figure 5:
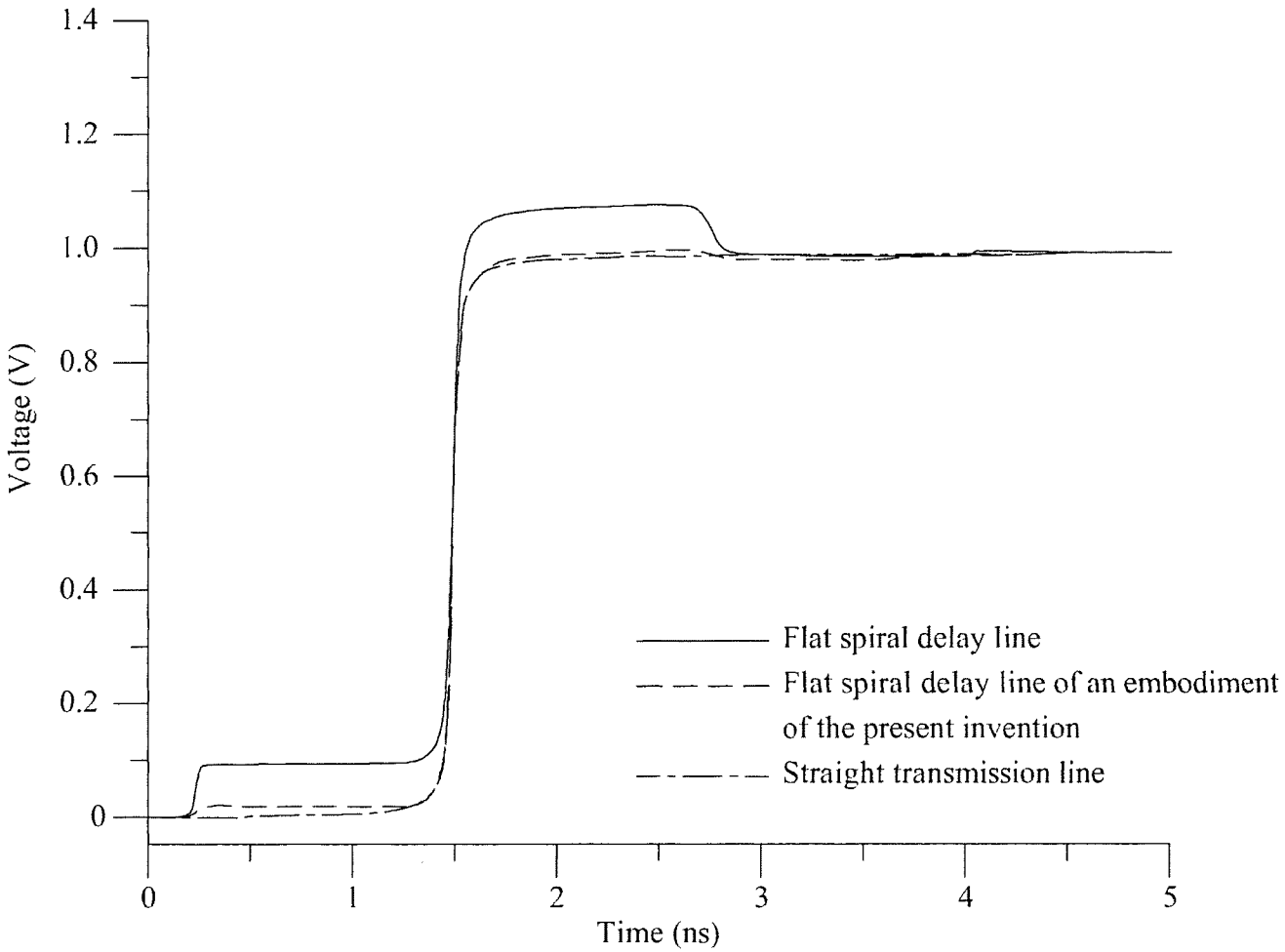
FIG. 5 is a measure figure showing the time domain transmits of various transmission lines.

Referring to FIG. 5, FIG. 5 is a measure figure showing the time domain transmits of various transmission lines. It is obvious that the waveform measured by a straight transmission line is an ideal square wave signal. On the contrary, the waveform measured by a flat spiral delay line without being installed with ground guard trace shows ups and downs, which is very different from the square wave signal. The waveform measured by the flat spiral delay line of the present invention is very close to the ideal square wave signal. In other words, the delay line structure of the present invention can effectively reduce the disturbance of crosstalk noise.

Figure 6:
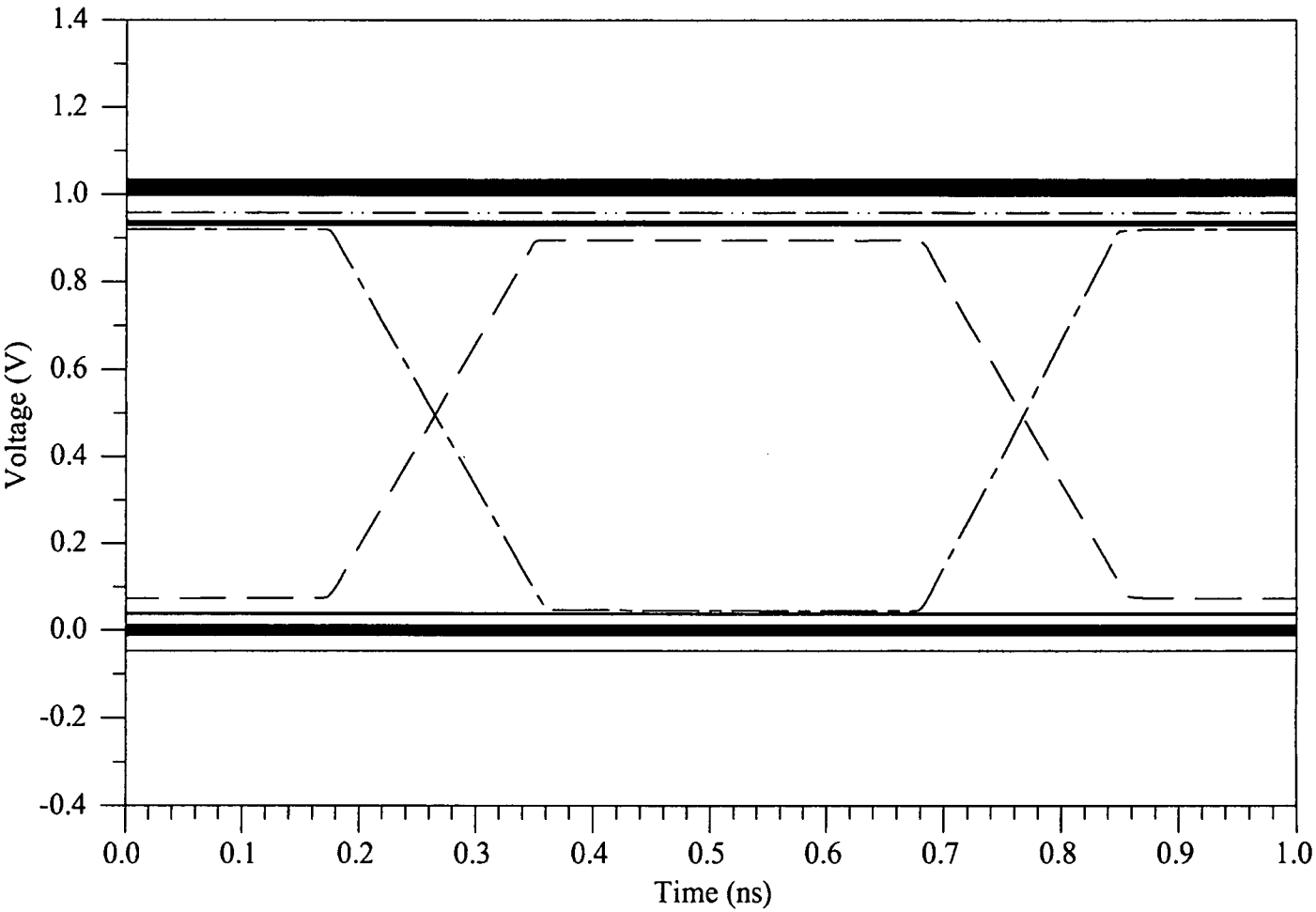
FIG.6(Prior Art)
FIG. 6 is an output eye diagram of a flat spiral delay line without being installed with ground guard trace in prior art.
Figure 7:
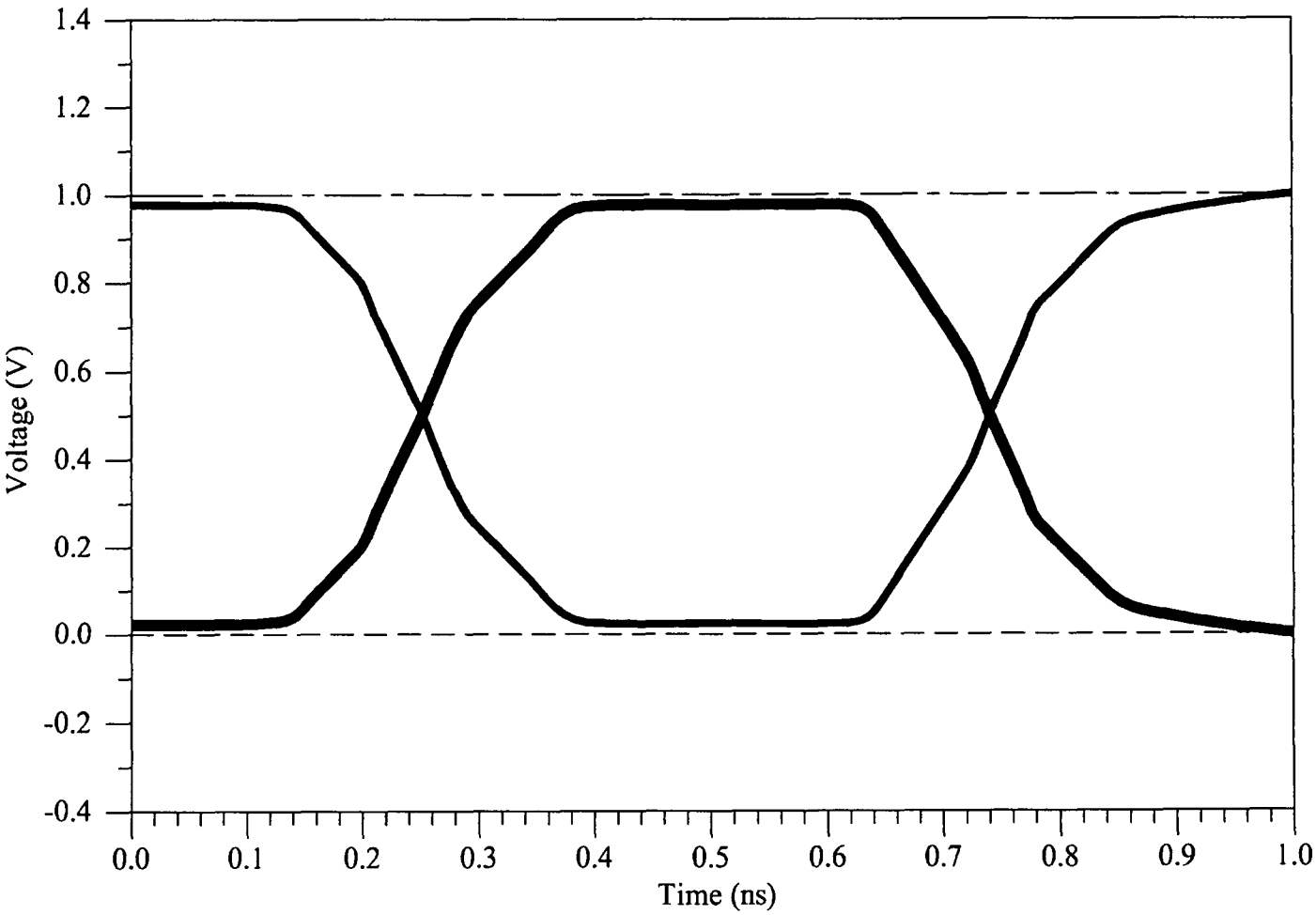
FIG. 7 is an output eye diagram of an embodiment of the flat spiral delay line of the present invention.

Referring to FIG. 6 and FIG. 7, wherein FIG. 6 is an output eye diagram of a flat spiral delay line without being installed with ground guard trace in prior art while FIG. 7 is an output eye diagram of an embodiment of a flat spiral delay line of the present invention. The abovementioned two eye diagrams are measured with an electronic measurement and simulation software, Advanced Design System (ADS) 2006, of the company of Agilent Technologies, Taipei, Taiwan. It is clear that the output eye diagram of a flat spiral delay line of the present invention has better signal integrity than the output eye diagram of a flat spiral delay line without being installed with ground guard trace in the prior art.

In conclusion, when compared with the delay line in the prior art, which is not installed with grounding guard traces, the present invention can avoid the crosstalk noise disturbance by means of two grounding guard traces connecting to the ground with an end. When compared with the flat spiral delay line having a guard trace with both ends connecting to the ground in the prior art, since there is no need to install the via inside the flat spiral delay line according to the present invention, the problem of being unable to downsize the flat spiral delay line is easily solved. Meanwhile, since a strip line structure can also applied in an embodiment of the present invention, it is more flexible for manufacturing.

While the present invention has been particularly shown and described with reference to a preferred embodiment, it will be understood by those skilled in the art that various changes in form and detail may be without departing from the spirit and scope of the present invention.

What is claimed is:

1. A delay line structure disposed on a substrate, the substrate including a grounding layer and a layout layer, the grounding layer including a grounding circuit, the delay line structure comprising:

a flat spiral delay line disposed in the layout layer extending from an input end, bending clockwise inward until reaching a U-turn part disposed substantially at a central portion of the delay line structure, continuously extending and bending counterclockwise outward to an output end so as to form two coupling areas, which are spiral and have an opening respectively; and two grounding guard traces disposed in the layout layer extending from the openings respectively toward the two coupling areas, each grounding guard trace ending without an interconnective via proximate the central portion of the delay line structure and having an interval between each of the two grounding guard traces and the flat spiral delay line respectively, wherein the two grounding guard traces close to the openings of the two coupling areas are electrically connected to the grounding circuit through a via respectively.

2. The delay line structure according to claim 1, wherein the layout layer is disposed inside the substrate.

3. The delay line structure according to claim 1, wherein the flat spiral delay line includes a strip line.

4. The delay line structure according to claim 1, wherein the substrate includes materials having a plurality of dielectric constants.

5. The delay line structure according to claim 1, wherein the two grounding guard traces are electrically connected to the vias respectively by an end, and the end is positioned outside the openings.

6. The delay line structure according to claim 1, wherein each grounding guard trace ends in substantially opposing directions towards a respective lateral first or second side of the layout layer in isolation one from the other by the spiral delay line.

7. The delay line structure according to claim 1, wherein the central portion is devoid of vias.

8. The delay line structure according to claim 1, wherein the flat spiral delay line extends from the input end disposed at a lateral first side of the layout layer to the output end disposed at a lateral second side of the layout layer, the second side being opposite from the first side.

9. A delay line structure disposed on a substrate, the substrate including a grounding layer and a layout layer, the grounding layer including a grounding circuit, the delay line structure comprising:

a flat spiral delay line disposed in the layout layer extending from an input end, bending counterclockwise inward until reaching a U-turn part disposed substantially at a central portion of the delay line structure, continuously extending and bending clockwise outward to an output end so as to form two coupling areas which are spiral and have an opening respectively; and two grounding guard traces disposed in the layout layer extending from the openings respectively toward the two coupling areas, each grounding guard trace ending without an interconnective via proximate the central portion of the delay line structure and having an interval between each of the two grounding guard traces and the flat spiral delay line respectively, wherein the two grounding guard traces close to the openings of the two coupling areas are electrically connected to the grounding circuit through a via respectively.

10. The delay line structure according to claim 9, wherein the two grounding guard traces are electrically connected to the vias respectively by an end positioned outside the openings.

11. The delay line structure according to claim 9, wherein the layout layer is disposed inside the substrate.

12. The delay line structure according to claim 9, wherein each grounding guard trace ends in substantially opposing directions towards a respective lateral first or second side of the layout layer in isolation one from the other by the spiral delay line.

13. The delay line structure according to claim 9, wherein the flat spiral delay line includes a strip line.

14. The delay line structure according to claim 9, wherein the central portion is devoid of vias.

15. The delay line structure according to claim 9, wherein the substrate includes materials having a plurality of dielectric constants.

16. The delay line structure according to claim 9, wherein the flat spiral delay line extends from the input end disposed at lateral first side of the layout layer to the output end disposed at a lateral second side of the layout layer, the second side being opposite from the first side. pectively by an end positioned outside the openings.

* * * * *